US005266763A

United States Patent [19]

Colombo

[11] Patent Number: 5,266,763

[45] Date of Patent: Nov. 30, 1993

[54] RECYCLABLE MICROWAVABLE CONTAINER WITH A REMOVABLE OUTER SHELL

[75] Inventor: Edward A. Colombo, Penfield, N.Y.

[73] Assignee: Mobil Oil Corporation, Fairfax, Va.

[21] Appl. No.: 690,189

[22] Filed: Apr. 16, 1991

[51] Int. Cl.[5] ..... H05B 6/80

[52] U.S. Cl. ..... 219/10.55 E; 99/DIG. 14; 426/234; 220/410

[58] Field of Search ..... 219/10.55 E; 99/DIG. 14; 426/107, 109, 234; 220/410

[56] References Cited

U.S. PATENT DOCUMENTS

| | | | |
|---|---|---|---|
| 4,439,656 | 3/1984 | Peleg | 219/10.55 E |
| 4,478,349 | 10/1984 | Haverland, Jr. et al. | 219/10.55 E |
| 4,661,672 | 4/1987 | Nakanaga | 219/10.55 E |
| 4,703,149 | 10/1987 | Sugisawa et al. | 219/10.55 E |
| 4,756,446 | 7/1988 | Gen et al. | 220/410 |
| 4,795,649 | 1/1989 | Kearns et al. | 219/10.55 E |
| 4,847,459 | 7/1989 | Desai | 219/10.55 E |
| 4,916,280 | 4/1990 | Havette | 219/10.55 E |
| 4,994,638 | 2/1991 | Iorns et al. | 219/10.55 E |

FOREIGN PATENT DOCUMENTS 60-84519 6/1985 Japan .

*Primary Examiner*—Philip H. Leung

*Attorney, Agent, or Firm*—A. J. McKillop; G. W. Hager

[57] ABSTRACT

A microwavable container useful in the microwave heating of items, particularly foodstuffs, comprises readily separable components. An outer shell which will remain relatively cool and, therefore, capable of being handled, surrounds an inner shell capable of sustaining high temperatures. A consumer may heat a food product in the inner shell of the present invention without risking contact with that inner shell when the inner shell becomes hot. After use, the components are readily separable for separate recycling processes.

1 Claim, 2 Drawing Sheets

RECYCLABLE MICROWAVABLE CONTAINER WITH A REMOVABLE OUTER SHELL

The present invention is directed to a microwavable container and, more particularly, to a microwavable container having improved recyclability.

BACKGROUND OF THE INVENTION

Containers for microwavable materials, particularly foodstuffs, have enjoyed increased marketing demand in recent times. The basic requirements for a microwavable container include high temperature resistance and adequate stiffness at elevated temperatures. Additionally, the outer surface should remain sufficiently cool such that the container may be safely handled.

Since most polymers having the necessary stiffness typically become quite hot when in contact with a heated foodstuff, it has previously been suggested to provide containers formed of laminates having an outer, insulating layer. For example, it has previously been suggested that a microwavable food packaging container be formed as a laminate with a polyethylene terephthalate film laminated on the interior of a foamed polystyrene sheet. The foamed polystyrene sheet material provides good heat insulation allowing such containers to be safely handled after microwaving. It has also been suggested to laminate other insulators, such as cardboard, to polymers to provide a safe, cool outer protective layer to microwavable containers. Alternatively, the use of a container having a core layer of a foamed thermoplastic polymeric material such as high density polyethylene or polypropylene laminated to surface layers of polyethylene terephthalate or polypropylene has also been suggested.

A significant disadvantage of previously known microwavable containers such as those discussed above lies in the difficulty in recycling laminates of different materials. Since these materials inherently have different requirements for recycling, it is desirable to first separate the layers prior to recycling. Such separating is very difficult and costly, making it impractical on a commercial scale. It would, therefore, be very desirable to provide a microwavable container having the desirable properties referred to above and which has components which are readily separable for recycling.

SUMMARY OF THE INVENTION

The present invention comprises a microwavable container useful in the microwave heating of items, particularly foodstuffs. The container of the present invention comprises readily separable components. An outer shell, which will remain relatively cool and therefore capable of being handled, advantageously supports an inner shell capable of sustaining high temperatures. A consumer may heat a food product in the inner shell of the present invention without risking contact with that inner shell when it becomes hot. After use, the components are readily separable for separate recycling processes.

DETAILED DESCRIPTION

The present invention advantageously provides a novel microwavable container which is inexpensive, easy to manufacture, has excellent microwaving properties, and is particularly adapted for efficient recycling.

According to one embodiment of the present invention, an outer shell is formed of a polymer, such as polystyrene, which has good structural properties for supporting a food product and is readily formed into desired shapes. Supported within the outer shell is an inner shell preferably formed of a polymer having high heat resistance, such as a polyester or polypropylene. The inner shell is preferably disposed within the outer shell such that a gap exists between the respective walls of the inner and outer shells. Those skilled in the art will appreciate that during microwaving, a foodstuff placed in the inner shell may become very hot thereby raising the temperature of the inner shell. By minimizing the area of contact between the walls of the inner and outer shells, the transfer of heat to the outer shell will be greatly reduced. As stated above, it is very desirable to provide an outer shell which does not become very hot during microwaving such that the entire container may be readily handled by a consumer even when that container is supporting a heated foodstuff.

The manner of maintaining a gap between the inner and outer shells may take different forms and need not eliminate all contact between these two components of the container of the present invention. According to one preferred embodiment of the present invention illustrated below, the inner shell is designed to contact the base of the outer shell at a limited number of points and only to contact the sidewalls of the outer shell near the top of the sidewalls.

Figure 1:
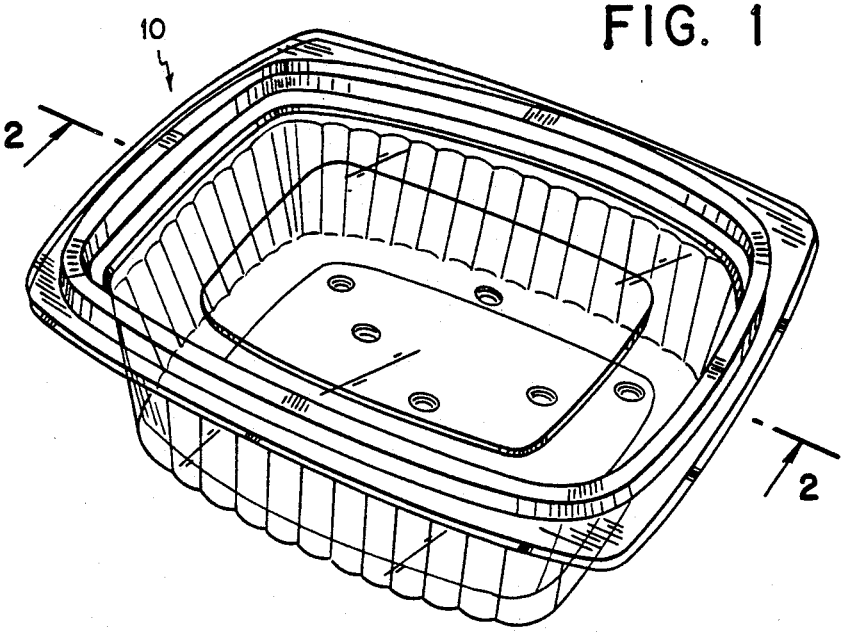
FIG. 1 is a perspective view of one embodiment of the present invention.
Figure 2:
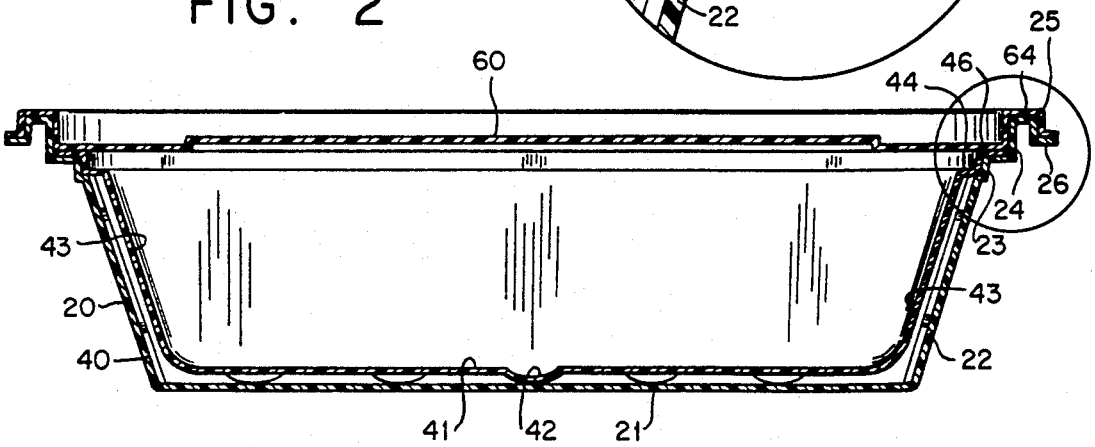
FIG. 2 is a cross-sectional view taken along lines 2—2 of the container illustrated in FIG. 1.
Figure 3:
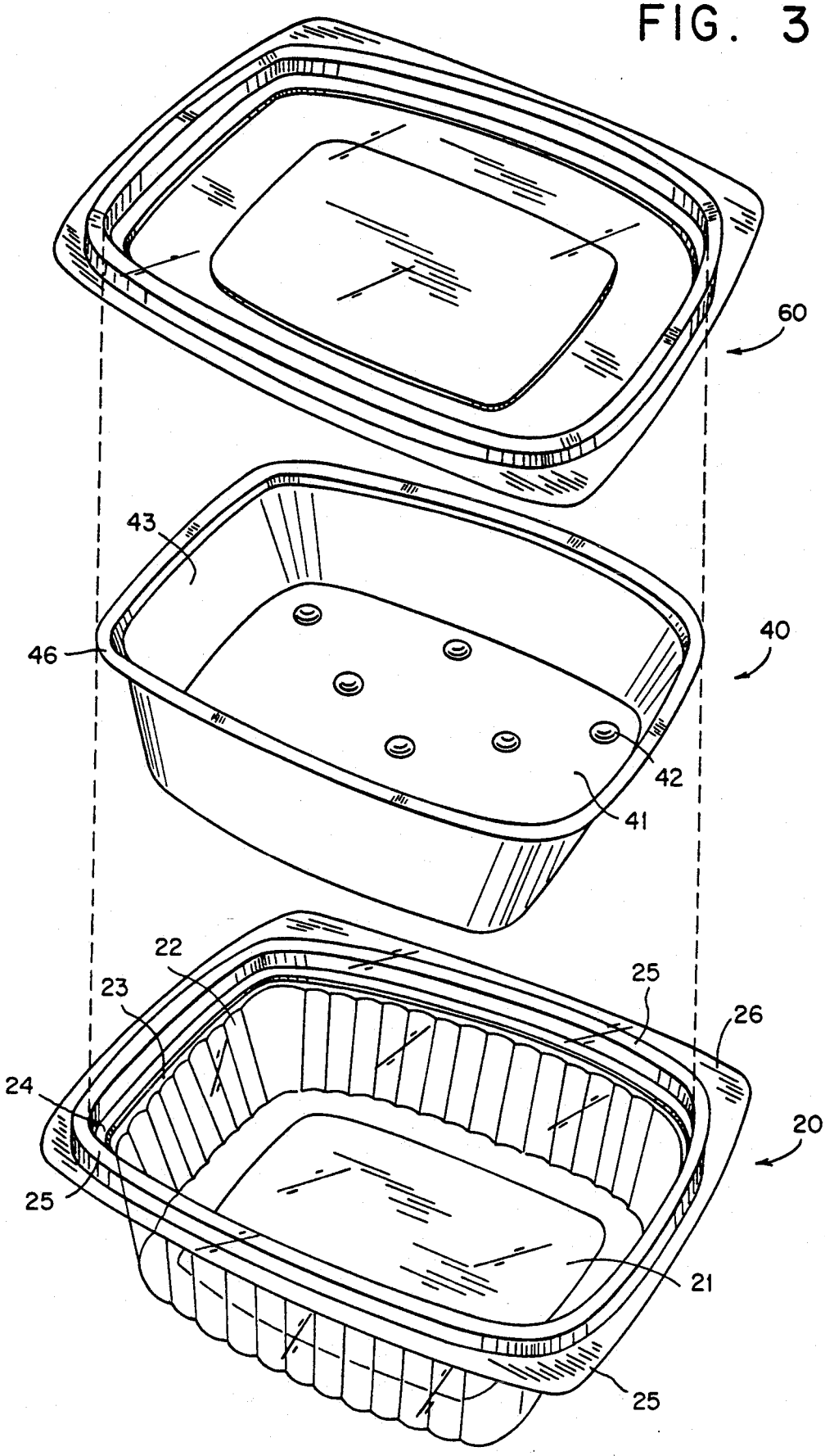
FIG. 3 is an exploded view of the container illustrated in FIG. 1.

FIGS. 1–3 illustrate one preferred embodiment of the present invention wherein container 10 is formed of three distinct components: an outer shell 20, an inner shell 40 and a lid 60. These three components are advantageously separately formed in a manner which permits quick assembly, either manually or mechanically, as well as rapid disassembly for separate cleaning and/or recycling operations.

In the illustrated embodiment, at least the outer shell 20 and lid 60 are most preferably formed of a clear, translucent polymer in order to facilitate continuous inspection of the contained foodstuff. While the present invention is described herein as a container particularly adapted for foodstuffs, those skilled in the art will appreciate that the benefits of the present invention may be applicable for the microwaving of other products.

With particular reference to FIGS. 2 and 3, the relationship of the three components is illustrated. According to this preferred embodiment of the present invention, outer shell 20 is formed having a base 21 and ribbed sidewalls 22 which extend upwardly and slightly outwardly from base 21. An outwardly extending lower flange 23, an upper flange 24 and then an upwardly extending rim 25 are integrally formed with the sidewalls 22. In this illustrated embodiment of the present invention an outer shelf 26 is also provided in order to provide a closer, tighter seal between outer shell 20 and lid 60 in a manner described in further detail above.

As stated above, outer shell 20 may be formed of any microwavable material which is rigid enough to support the weight of the foodstuff, such as polystyrene, especially oriented polystyrene, high-impact polystyrene, and blends thereof. If the manufacturer does not require a product that enables visibility of the foodstuff, a more economical foamed polystyrene may be utilized. Other suitable polymeric materials include high impact polystyrene, amorphous polyester, polyvinyl chloride, polyethylene, blends and copolymers thereof.

Inner shell 40 is advantageously designed for placement within outer shell 20 in a manner which minimizes the contact between the respective bases and sidewalls of each of these shells. Inner shell 40 of the illustrated embodiment is formed with a base 41 having a limited number of dimples 42 or other supportive geometries. For example, base 41 may be provided with about ten spaced dimples 42 in order to provide broad structural support to the base 41 while minimizing the area of actual contact between these separate shells. Inner shell 40 also has sidewalls 43 which extend upwardly and slightly outwardly from inner shell base 41. Inner shell sidewalls 43 terminate in a lower flange 44 which extends horizontally a distance of about 0.1 inch. This lower flange 44 is integrally formed with flange 46 and sidewalls 43.

Inner shell 40 may be formed of any microwavable, heat resistant material. Inner shell is preferably formed of a crystallized polyester, polypropylene or copolymers thereof. Other suitable materials include styrene maleic anhydride, talc filled polypropylene, high melt strength polypropylene, high crystallinity polypropylene, polyphenylene oxide blended with polystyrene of high impact polystyrene, blends and copolymers thereof including foamed or solid sheets thereof. As used herein with respect to the inner shell, the term "heat resistant" indicates that the inner shell will maintain its structural integrity even when contacted by a foodstuff heated to a temperature of about 200°-250° F.

Figure 4:
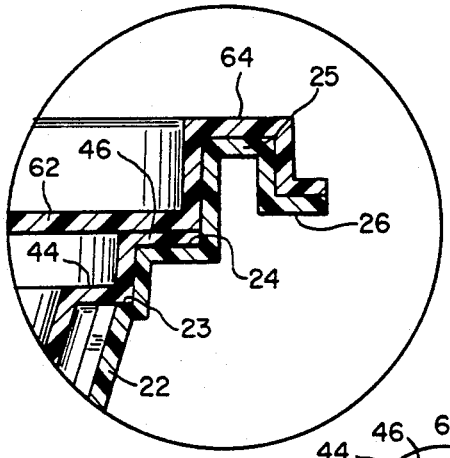
FIG. 4 is an enlarged view of the circled portion of FIG. 2.

The cooperative relationship between the upper rim sections of both the outer shell 20 and inner shell 40 are more clearly illustrated in the cross-sectional view of FIG. 2 and enlarged view of FIG. 4. In the manner illustrated, upper flange 46 of inner shell 40 is designed to rest upon upper flange 24 of outer shell 20. Furthermore, in order to provide additional support for the spaced relationship of the inner shell 40 with respect to outer shell 20, the bottom face of lower flange 44 is adapted to rest upon lower flange 23 of outer shell 20.

In order to releasably attach inner shell 40 to outer shell 20, the upper flange 24 of outer shell 20 is formed with an outer diameter slightly greater than the inner diameter defined by the inner wall of rim 25. This slight difference is designed to releasably accommodate upper flange 46 of inner shell 40 which may be snap-fit within rim 25 by a slight application of pressure to upper flange 46. In this fashion, inner shell 40 is releasably secured within outer shell 20. Thus, once inner shell 40 has been inserted into outer shell 20, the outer shell 20 may be inverted without displacing inner shell 40. However, when it is desired to separate inner shell 40 from outer shell 20, the application of upward pressure to the inner sidewalls 43 of inner shell 40 will be sufficient to disengage inner shell 40 from outer shell 20 due to the inherent resiliency of the materials used in forming these components. The illustrated embodiment of the present invention may be readily separated by hand. Those skilled in the art will appreciate that alternative arrangements for releasably attaching the inner shell and outer shell of the present invention may be utilized without departing from the present invention.

FIG. 2 also illustrates the spaced relationship between inner shell 40 and outer shell 20. As illustrated, the two shells only have actual contact at the positions of the several dimples 42 in the base 41 of inner shell 40 and in the upper regions of their respective sidewalls.

According to this illustrated preferred embodiment of the present invention, a lid 60 is also provided in order to protect a foodstuff placed within container 10 and to avoid splashing during the heating of the subject foodstuff. As illustrated, lid 60 is provided with an upwardly extending rim 64 shaped to complement upwardly extending rim 25 of outer shell 20. In the manner best illustrated in FIG. 4, the upper section of rim 25 is slightly wider than the rest of rim 25 thereby providing a seal with complementary shaped rim 64 of lid 60. Lid 60 also has a substantially planar central portion 62 whose outer edges are adapted to engage upper flange 46 of inner shell 40 thereby providing additional, releasable securement to the inner shell within outer shell 20.

Lid 60 may be formed of any suitable microwavable material and is preferably formed of a clear, substantially rigid polymer such as those described above for use with outer shell 20.

While the dimensions and actual configuration of the components of the present invention may be readily selected in light of the present description by one skilled in the art, a thickness of about 10-15 mils has been found suitable for an inner shell 40 formed of the materials referenced above. Both outer shell 20 and lid 60 have been found suitable when formed with thicknesses of about 15-20 mils using an oriented polystyrene or blends of oriented polystyrene and high impact polystyrene.

While the illustrated embodiment of the present invention has been described as being formed from one or more polymeric materials, those skilled in the art will appreciate that the structural advantages of the present invention may be obtained using other materials such as paper, polycoated paper, glass or ceramic.

From the above description, it will also be appreciated by those skilled in the art that after the container of the present invention has been used, the components may be very easily separated for cleaning and reuse or separate recycling operations. The present invention therefore overcomes the disadvantages inherent in many microwavable containers previously disclosed which utilized different polymers which were coextruded, laminated, or otherwise permanently bonded. The present invention provides the further benefit of an insulating air gap between the outer shell, which must be handled by a consumer, and the inner shell which is in contact with the heated foodstuff.

While illustrated generally in the form of a deep dish tray, the advantages of the present invention may be enjoyed when the container is formed in other shapes including plates, cups, bowls, hinged-lid containers, etc.

Furthermore, in addition to the above described advantages, those skilled in the art will appreciate that the present invention may be formed such that it is less expensive than a container made totally from high temperature resins.

I claim:

1. A microwavable container comprising:

i) an outer shell comprising a first microwavable polymeric material, ii) an inner shell comprising a second microwavable polymeric material different from said first microwavable polymeric material, said inner shell disposed in substantially spaced relation to said outer shell and further comprising means for releasably securing said inner shell to said outer shell, iii) a lid having means for releasably securing said lid to said inner and said outer shells, wherein said inner shell further comprises an upper flange formed around the perimeter of said outer shell, said outer shell further comprises a rim formed around the perimeter of said inner shell and said means for releasably securing said lid to said inner and said outer shell comprises an upwardly extending rim cooperatively shaped and dimensioned for securedly receiving said upper flange of said inner shell and said rim of said outer shell.

* * * * *